US007367165B2

(12) United States Patent
Hatzinikolas

(10) Patent No.: US 7,367,165 B2
(45) Date of Patent: May 6, 2008

(54) MOISTURE CONTROL STRIP

(75) Inventor: Michael Hatzinikolas, 15305-117 Avenue, Edmonton (CA) T5M 3X4

(73) Assignee: Michael Hatzinikolas, Edmonton, ALberta (CA)

( * ) Notice: Subject to any disclaimer, the term of this patent is extended or adjusted under 35 U.S.C. 154(b) by 423 days.

(21) Appl. No.: 10/814,135

(22) Filed: Apr. 1, 2004

(65) Prior Publication Data

US 2005/0246987 A1 Nov. 10, 2005

(51) Int. Cl.
*E04B 1/70* (2006.01)

(52) U.S. Cl. ..... 52/302.3; 52/302.1; 52/408; 52/352; 52/302.6

(58) Field of Classification Search ..... 52/60, 52/61, 310, 413, 302.1, 302.3, 169.5, 169.14, 52/5, 408, 352, 302.6, 732.2, 302.2; 211/106, 211/191, 187

See application file for complete search history.

(56) References Cited

U.S. PATENT DOCUMENTS 601,753 A * 4/1898 Kaiser ..... 211/41.2
2,609,956 A * 9/1952 Stevenson ..... 217/42
3,498,015 A * 3/1970 Green et al. ..... 52/310
6,298,620 B1 * 10/2001 Hatzinikolas ..... 52/302.1
6,990,775 B2 * 1/2006 Koester ..... 52/302.1

OTHER PUBLICATIONS

The RainScreen Panel, Korax Technologies Inc. pages included from http://www.korwaxtech.com/panel_2.html.
Rainscreen Cladding, Eurofox Engineering Ltd. pages included from http://www.eurofoxengineering.com/engineering/rainscreen/.
Rainscreen, Intergulf Cascadia pages included from http://www.intergulf.com/corporate/rainscreen.html.

* cited by examiner

*Primary Examiner*—Carl Friedman
*Assistant Examiner*—Jonathan Junker
(74) *Attorney, Agent, or Firm*—Philip C. Mendes da Costa; Bereskin & Parr

(57) ABSTRACT

A wall is provided comprising an inner wall component, an outer wall component, and a plurality of the moisture control strips described above, disposed between the inner wall component and the outer wall component. The projections on the first wall component contacting face engage one of the inner wall component and the outer wall component. The second wall component contacting face engages the other of the inner wall component and the outer wall component. The moisture control strips are horizontally spaced from each other within the wall.

14 Claims, 7 Drawing Sheets

MOISTURE CONTROL STRIP

FIELD OF THE INVENTION

The present invention relates to the control of moisture within walls, and more particularly to a moisture control strip for use in wall construction.

BACKGROUND OF THE INVENTION

Structural walls for buildings such as residential, commercial, or industrial buildings, are often constructed in layers. Typically, a wall sits on a foundation, and includes a backup wall having a floor plate and a ceiling plate and a set of vertical studs. Usually, sheathing (which may be plywood, oriented strand board, or the like) is disposed on the outside face (i.e. the face that faces towards the outside of the building) of the backup wall. The sheathing is covered by a moisture barrier membrane. A metal flashing is disposed at the bottom of the wall, above the foundation and between the sheathing and the membrane.

On the outside of the membrane, a layer of thermal insulation is typically installed. In some cases, moisture control panels, such as that described in published Canadian Patent Application 2,249,509 and owned by the applicant herein, are disposed outside of the insulation. Fasteners are installed through the moisture control panel, the insulation, the membrane, the sheathing and into the vertical stud to hold the moisture control panel and insulation in place within the wall. A wire mesh supporting a layer of stucco is disposed on the outside of the moisture control panel, with the mesh also being held in place by the fastener.

SUMMARY OF THE INVENTION

In a first aspect, the invention is directed to a moisture control strip including an elongate member having first and second wall component contacting faces. The second wall component contacting face is opposed to the first wall component contacting face. The member has a width across the first and second wall component contacting faces. The first wall component interface side has a plurality of projections defined thereon. The projections are spaced vertically from each other.

In a second aspect, the invention is directed to a wall comprising an inner wall component, an outer wall component, and a plurality of the moisture control strips described above, disposed between the inner wall component and the outer wall component. The projections on the first wall component contacting face engage one of the inner wall component and the outer wall component. The second wall component contacting face engages the other of the inner wall component and the outer wall component. The moisture control strips are horizontally spaced from each other within the wall.

In a third aspect, the invention is directed to a method of making a moisture control strip, comprising:

(a) providing a longitudinally extending member having a generally rectangular cross-sectional shape; and (b) forming a plurality of laterally extending grooves across the entire width of the member, wherein the grooves are spaced longitudinally from each other, and wherein the grooves are defined at least in part by an upper face and a lower face, and wherein the upper and lower faces extend at a downward slope angle in a direction into the member.

BRIEF DESCRIPTION OF THE DRAWINGS

For a better understanding of the present invention and to show more clearly how it may be carried into effect, reference will now be made by way of example to the accompanying drawings, in which.

DETAILED DESCRIPTION OF THE INVENTION

Figure 1:
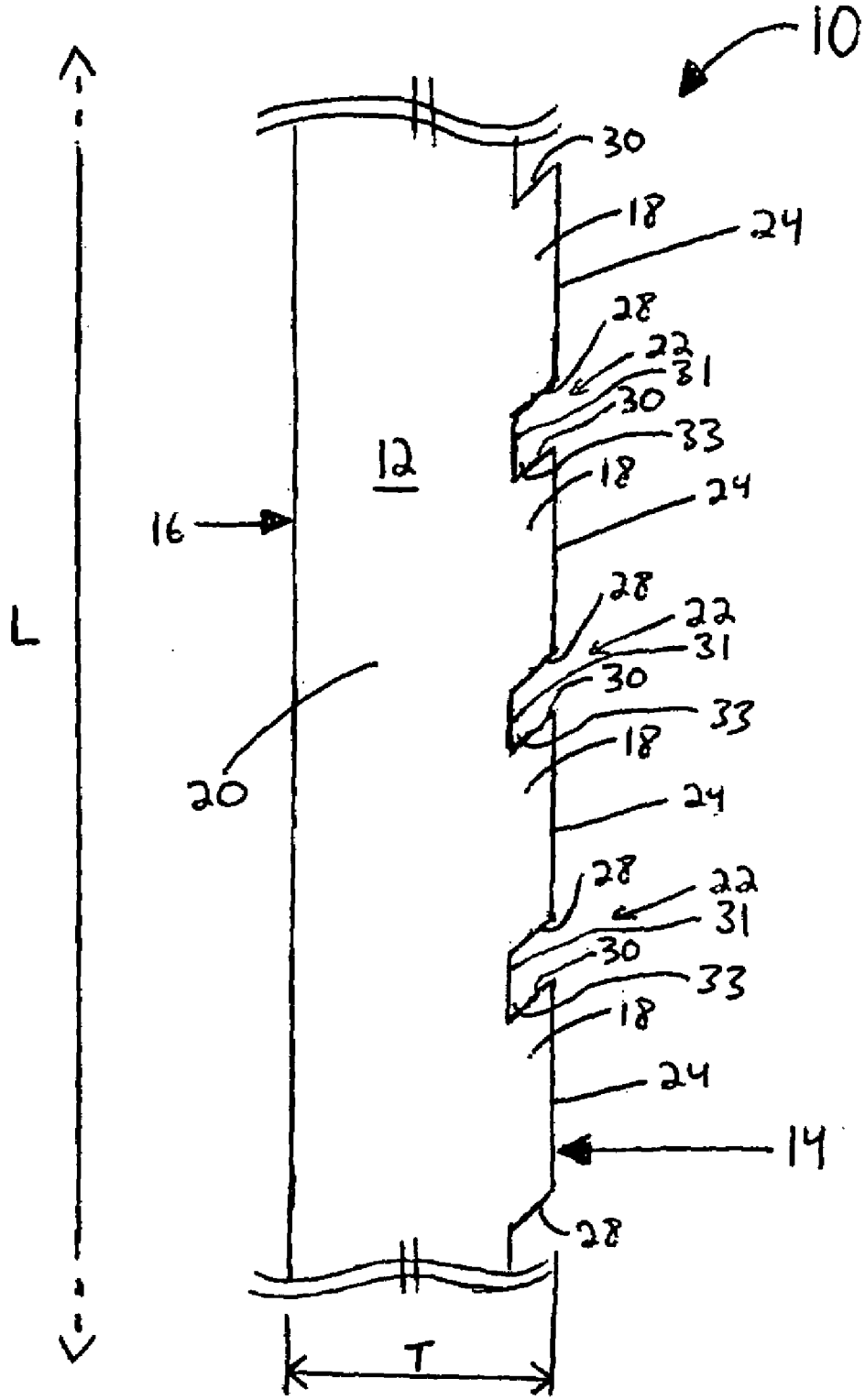
FIG. 1 is a side view of a moisture control strip in accordance with a first embodiment of the present invention.
Figure 2:
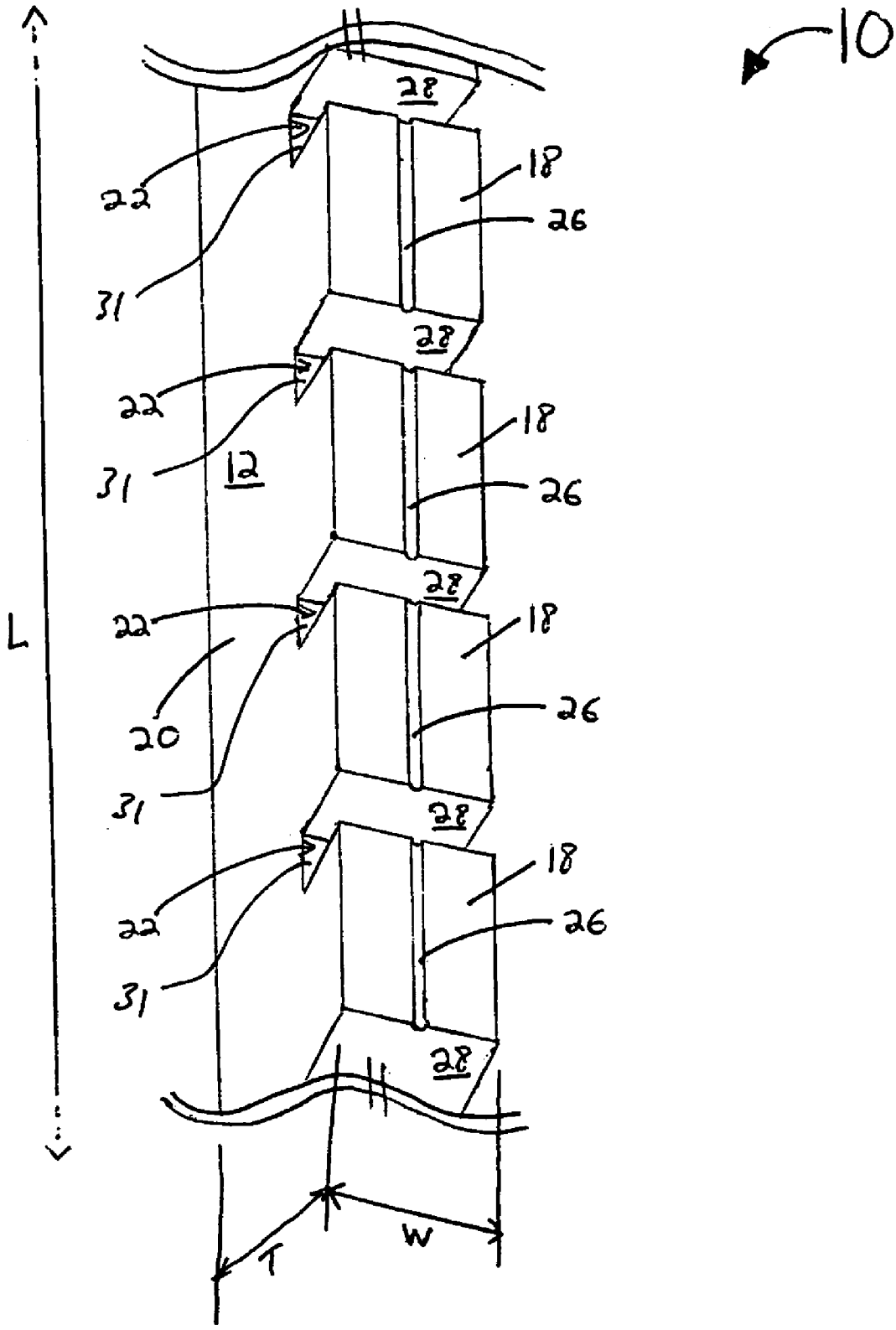
FIG. 2 is a perspective view of the moisture control strip shown in FIG. 1.

Now referring to FIGS. 1 and 2, a moisture control strip according to the present invention is shown generally at 10. The moisture control strip 10 comprises an elongate member 12 having a length L in a longitudinal direction which may be substantially greater than its width W (see FIG. 2), and substantially greater than its thickness T.

The elongate member 12 has first and second substantially oppositely facing wall component contacting faces 14 and 16, respectively, and two side faces 20 extending therebetween. The first wall component interface side 14 has a plurality of spaced projections 18 may be defined thereon, while the second wall component contacting face 16 may be generally planar.

Figure 4:
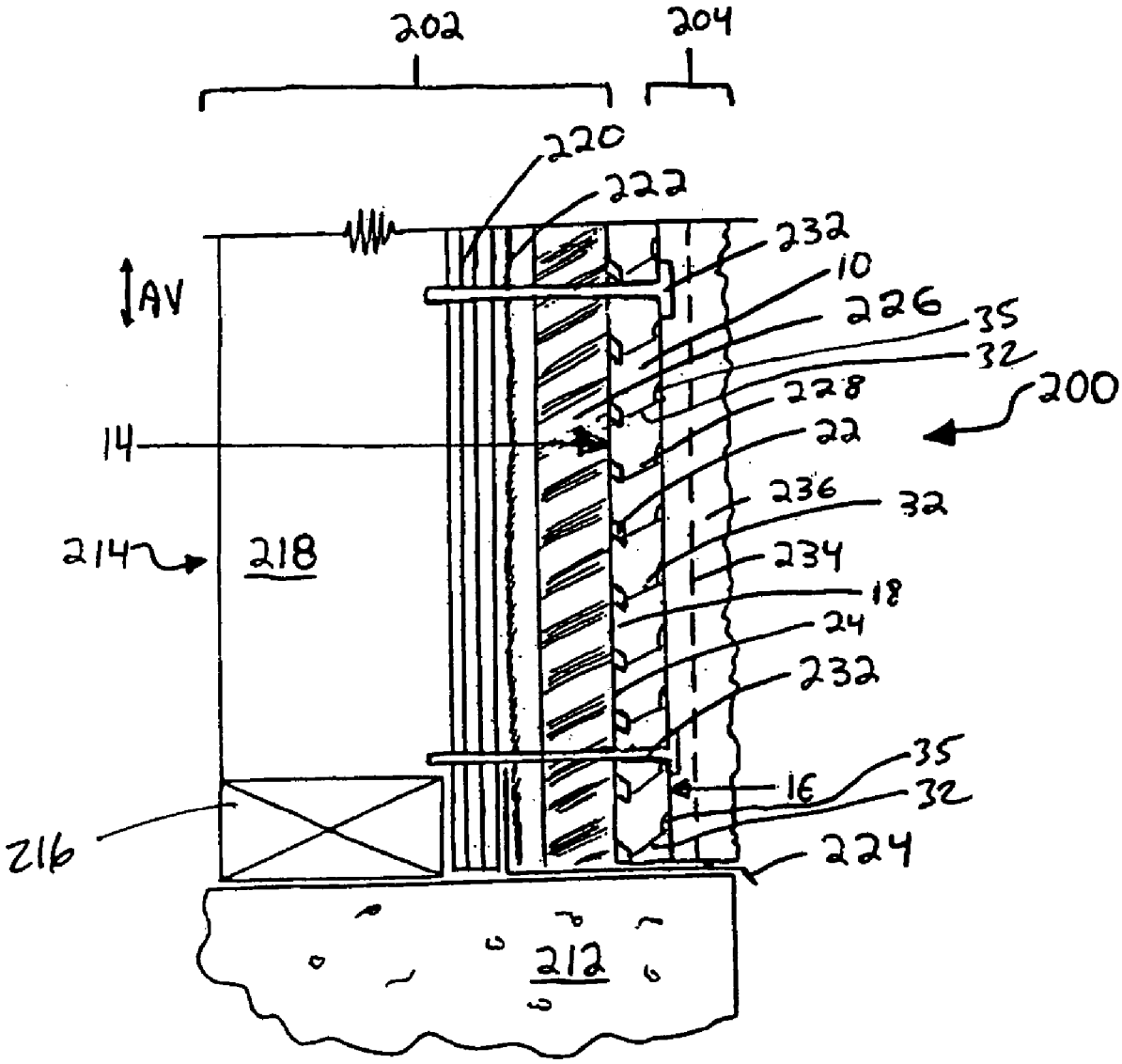
FIG. 4 is a sectional side view of a wall having the moisture control strip shown in FIG. 1 installed in a first configuration.

Each projection 18 has a wall component contacting surface 24 thereon for contacting a wall component adjacent the moisture control strip (see, FIG. 4).

Each projection 18 may extend across the entire width W of the strip 10, and is spaced from any adjacent projections 18 by a laterally extending groove 22. The groove 22 has an upper face 28, a lower face 30 and an inner face 31. The upper face 28 extends downwards in a direction inwards from the wall component contacting surface 24 of the projection 18 above the groove 22. The lower face 30 extends downwards in a direction inwards from the wall component contacting surface 24 of the projection 18 below the groove. The inner face 31 may be generally parallel to the wall component contacting surfaces 24. A trough 33 is formed at the intersection of the lower face 30 and the inner face 31. The trough 33 is open at both ends.

When the projections 18 contact a wall component, the upper and lower faces 28 and 30 both are configured by their slope angle, to convey into the trough 33 droplets of moisture that they catch running down the wall component. The droplets of moisture may form on the wall component, for example, as a result of condensation. Moisture collected in the trough 33 eventually can be drained off at the two open ends of the trough 33, down the side faces 20 of the moisture control strip 10.

Further, because the groove 22 is open at both ends, it provides airflow and aeration to the wall component against which the projection 18 is abutted, facilitating drying of the wall component, relative to a strip or panel in which no grooves were present that permitted aeration.

Prior to machining the grooves 22, the moisture control strip 10 may initially be a longitudinally extending member having a rectangular (eg. square) cross-sectional shape. Each groove 22 may be machined in a single pass in the moisture control strip 10, by moving an appropriately configured cutting tool (not shown) across the width of the first wall component contacting face 14, which is, in the embodiment shown in the Figures, is the width W of the strip 10. By having the projections extend across the entire width W of the first wall component contacting face 14 simplifies the machining required to form the projections 18 ie. so that machining across the width of the first wall component contacting face 14 is sufficient to form the projections 18, which in turn reduces the cost of manufacture for the moisture control strips 10. It will be noted that the grooves 22 may be formed by any other suitable means instead of machining.

A vertical groove 26 (see FIG. 2) may extend downwards along the height of each wall component contacting face 24. Thus, when the projections 18 contact a wall component, the groove 26 remains open to air at both ends. In similar fashion to the groove 22, the groove 26 also facilitates aerating and thus drying of the surface of the wall component where it is in contact with the wall component contacting face 24, if the wall component becomes wet in this contact region.

Figure 3:
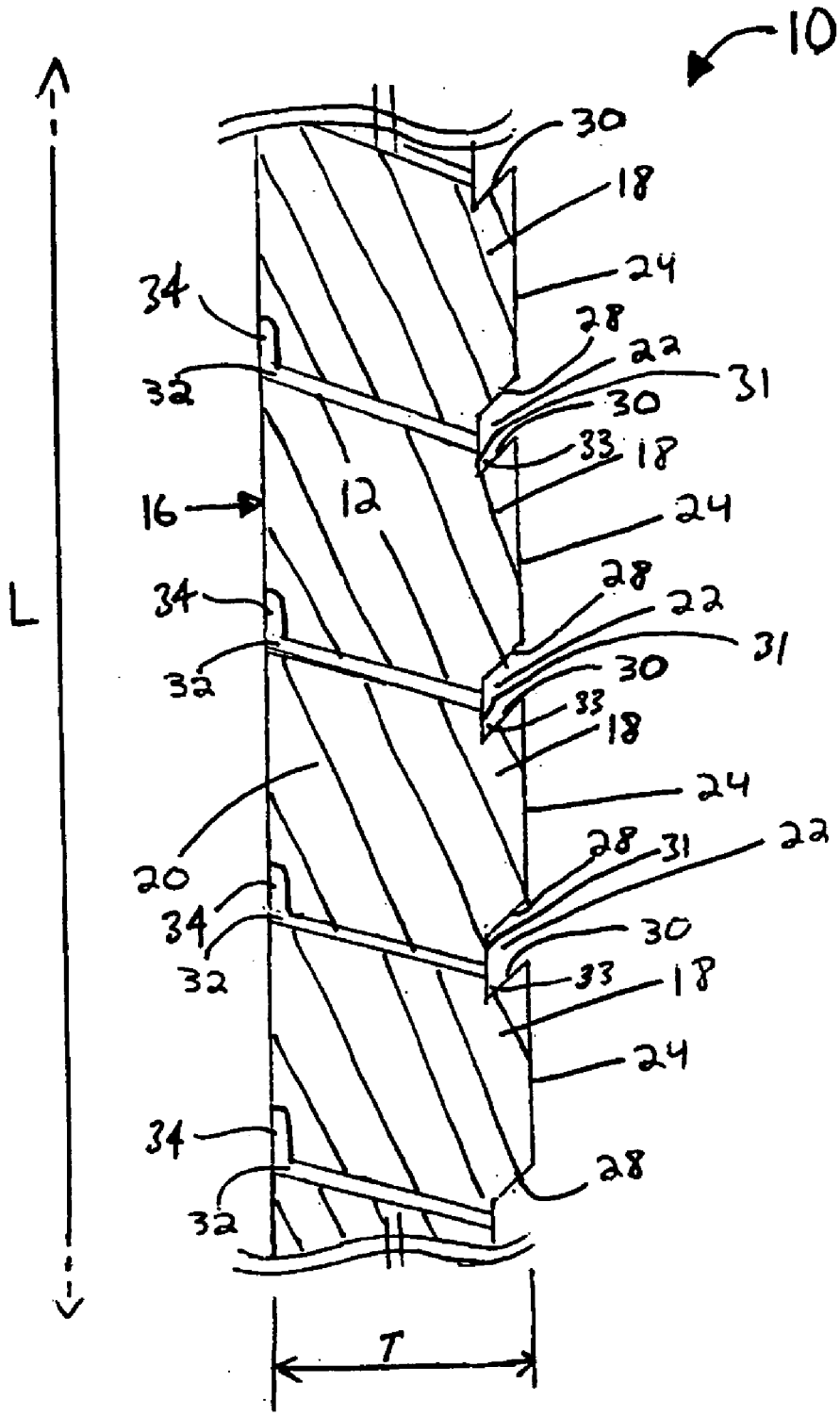
FIG. 3 is a sectional side view of the moisture control strip shown in FIG. 1.

Referring to FIG. 3, the moisture control strip 10 may further include a series of recesses 34 and apertures 32 on the second wall component contacting face 16. The recesses 34 function to collect moisture from the wall component contacted by the face 16. At the bottom of each recess 34, an aperture 32 extends therefrom downwards through the moisture control strip 10 to a trough 33 on the opposing face 14. The aperture 32 conveys away moisture collected in the recess 34 down to the trough 33, where the moisture can then be drained off down the side faces 20.

Figure 5:
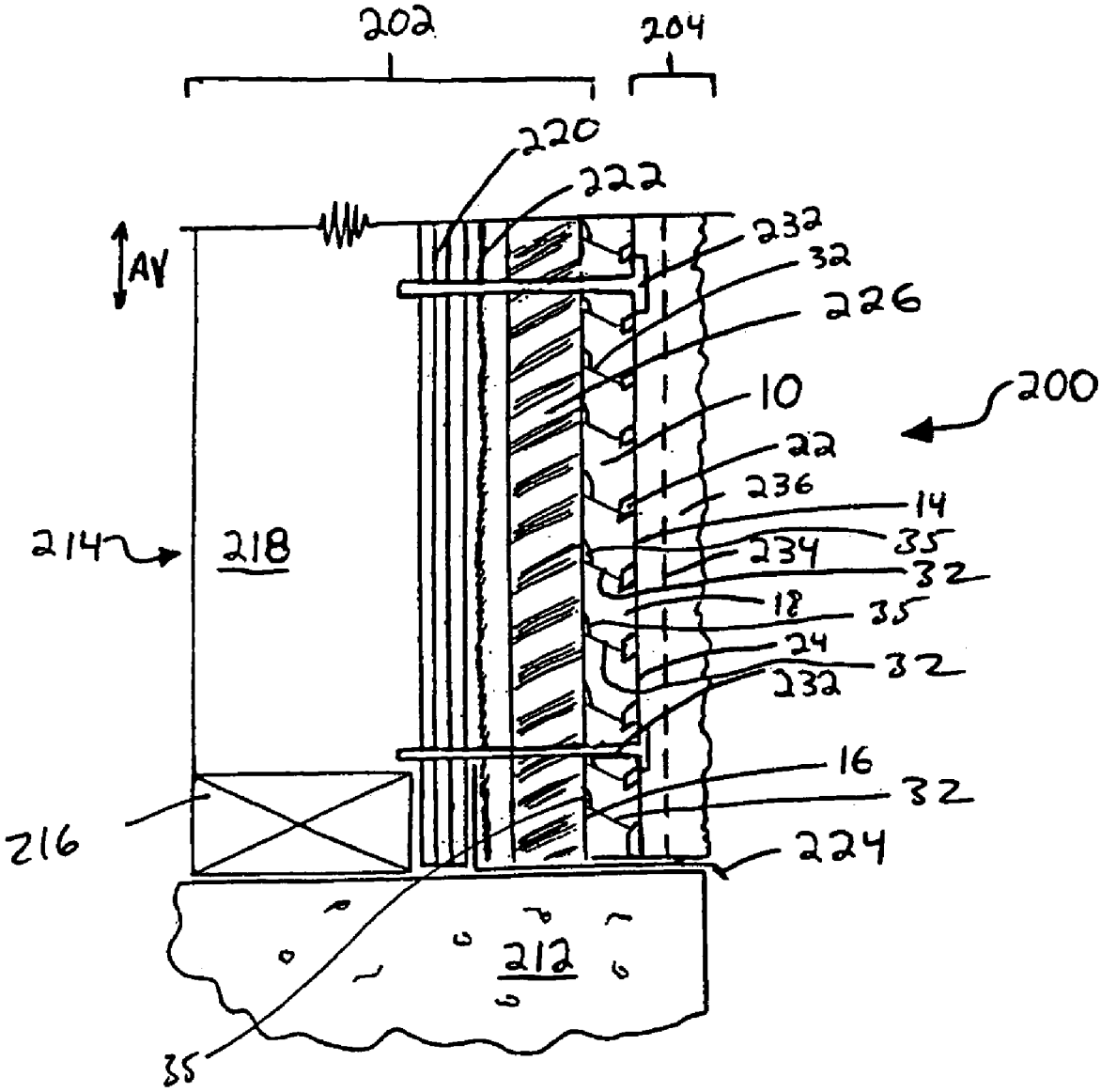
FIG. 5 is a sectional side view of a wall having the moisture control strip shown in FIG. 1 installed in a second configuration.

With reference to FIGS. 4 and 5, a moisture control strip 10 according to the present invention is shown installed in a wall. FIG. 4 shows the moisture control strip 10 installed in a first orientation, and FIG. 5 shows the moisture control strip 10 installed in a second orientation. The wall is shown generally at 200, and comprises an inner wall component 202, and an outer wall component 204, with a plurality of moisture control strips 10 disposed between the inner wall component 202 and the outer wall component 204.

The wall 200 sits on a foundation 212, and includes a backup wall 214, which has a floor plate 216 and a ceiling plate (not shown) and a set of vertical studs 218. One such vertical stud 218 is shown. Sheathing 220, which may be made of plywood, oriented strand board or some other suitable material, is disposed on the outside face of the backup wall 214. A moisture barrier membrane 222 covers the sheathing 220. A metal flashing 224 is disposed at the bottom of the wall 10, between the sheathing 220 and the membrane 222 and above the foundation 212. A layer of thermal insulation 226 is installed on the outside of the membrane 222. The layer of insulation 226 may be rigid insulation, or alternatively, it may comprise batt or other non-rigid insulation sheathed with a wood panel sheathing on its outside face. Thus, the inner wall component 202 comprises the vertical studs 218, the sheathing 220, the membrane 222 and the layer of thermal insulation 226. The layer of thermal insulation 226, which may be rigid, comprises the outer surface of the inner wall component 202. Alternatively, if no thermal insulation were installed, the membrane 222 would comprise the outer surface of the inner wall component 202. The outer wall component 204 comprises wire mesh 234 having a layer of stucco 236 supported thereon. As will be appreciated by one skilled in the art, the layer of stucco 236 is somewhat moisture previous. As can be seen, the moisture control strips 10 are oriented such that their longitudinal direction (in which their length L is measured) corresponds to a vertical axis AV of the wall 200. The wall components, including the moisture control strips 10, are held together by fasteners 232.

The moisture control strips 10 may be positioned in the wall 200 with the first wall component contacting face 14 facing the inner wall component 204, as shown in FIG. 4. In the orientation shown in FIG. 4, the first wall component contacting face 14 faces the layer of insulation 226, and the second wall component contacting face 16 faces the mesh wire 234 and stucco 236. In the orientation shown in FIG. 5, the first wall component contacting face 14 faces the outer wall component 204, which may include, for example, the wire mesh 234 and the layer of stucco 236, and the second wall component contacting face 16 faces the insulation 226.

Figure 6:
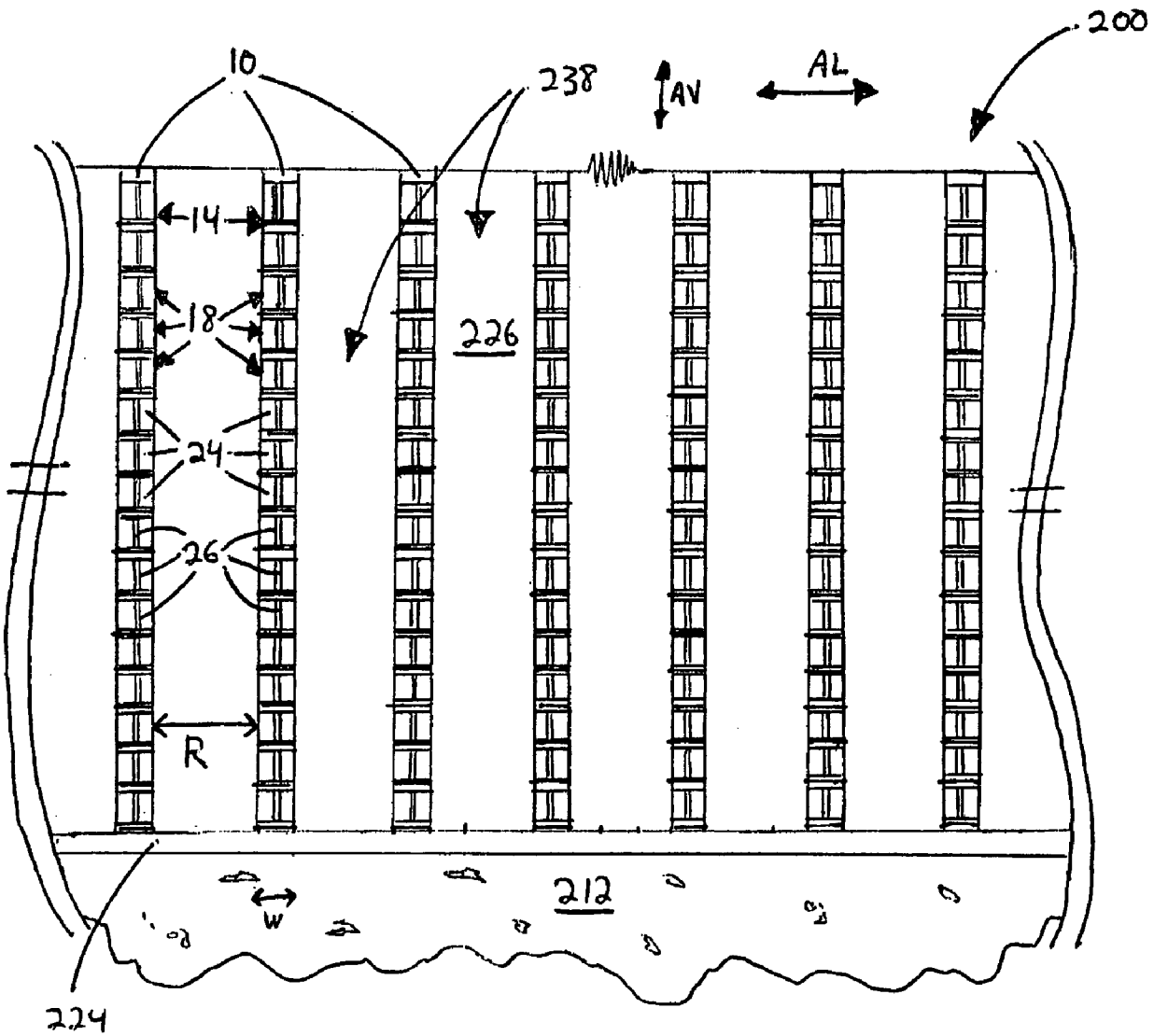
FIG. 6 is a front cut-away view of a wall having a plurality of the moisture control strips shown in FIG. 1 installed therein in the configuration shown in FIG. 4.
Figure 7:
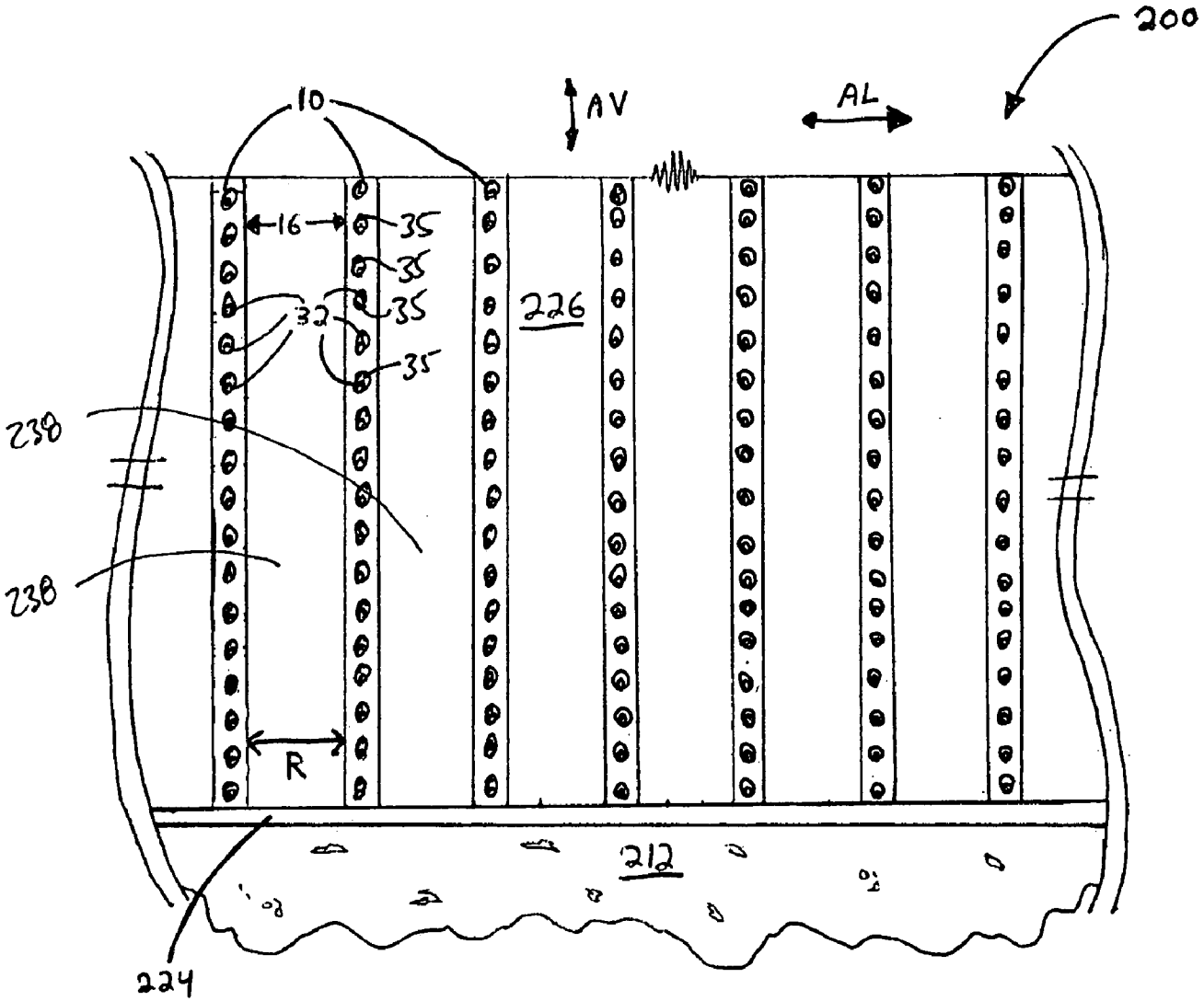
FIG. 7 is a front cut-away view of a wall having a plurality of moisture control strips of the embodiment shown in FIG. 1 installed therein in the configuration shown in FIG. 5.

Referring to FIG. 6, when the moisture control strips 10 are positioned in the orientations shown in FIG. 4, the moisture control strips 10 may be positioned horizontally spaced from one another by a distance R, so that an airspace 238 is defined between pairs of adjacent strips 10. The width of the airspace 238 (ie. the distance R) between adjacent strips 10 may be selected based on a number of factors including, for example, the size and strength of the mesh wire 234 (FIG. 4) that is positioned thereon for supporting the layer of stucco 236. FIG. 7 shows a similar arrangement of horizontally spaced strips 10 in the orientation shown in FIG. 5.

In the airspaces 238, ie. the regions between the moisture control strips 10, any moisture buildup on the layer of stucco 236 or on the layer of insulation 226 can drain downwards along the stucco layer 236 onto the flashing 224 and out. Referring to FIG. 4, where each strip 10 contacts the layer of stucco 236, moisture in the stucco 236 can be collected in the recesses 34 and conveyed away through the apertures 32, as described above.

Using a plurality of moisture control strips 10 that are spaced apart by a selected distance R from one another provides several advantages over using a moisture control panel such as that shown in Canadian patent application 2,249,509. One advantage is that the cost of the moisture control strips 10 is substantially lower than that of the aforementioned panel. This is because the strip consumes less base material, and requires substantially less machining.

Another advantage is that the spaced strips 10 create fewer heat conduction paths though the wall 200 than are created by a large, wide panel. In other words, the overall heat loss through the wall 200 is lower using the moisture control strips 10 than using a panel.

It is contemplated that the orientation of the moisture control strip 10 will be selected based on which of the inner and outer wall components 202 and 204 is more likely to build up moisture. For example, with respect to condensation of water vapour in the air between the inner and outer components 202 and 204, the wall component that receives more condensation will depend at least in part on the ambient temperatures expected on both sides of the wall 200. Also, moisture buildup can occur in one or both of the inner and outer wall components 202 and 204 as a result of such factors as damp weather conditions outside and humidity conditions inside. These and other considerations will influence which orientation best serves the function of the moisture control panel 10.

In similar fashion to the configuration shown in FIG. 4, in the airspaces, ie. the regions between the moisture control strips 10 in the orientation shown in FIG. 5 moisture buildup on the layer of stucco 236 and on the layer of insulation 226 can drain downwards along the insulation layer 236 onto the flashing 224 and out. Where each strip 10 contacts the layer of insulation 226, moisture running down the layer of insulation 226 can be collected in the recesses 34 if they are provided, and conveyed away through the apertures 32 if they are provided, as described above.

In the embodiments described above, the grooves 22 extend strictly laterally across the width of the first wall component contacting face 14. It is alternatively possible for the grooves 22 to extend laterally across the width of the first wall component contacting face 14, but at an angle with respect to a lateral axis AL (FIGS. 6 and 7), so that the grooves 22 promote the drainage of moisture on a particular side of the moisture control strip 10. As another alternative, the grooves 22 may be generally chevron shaped, while still extending across the width of the first wall component contacting face 14. In this case, the apex of the chevron would be higher than the ends of the chevron, so that moisture is promoted to be drained off both ends of the groove.

The grooves 22 have been described as being configured to convey moisture away from the surface with which they are in contact (eg. the inner or outer wall components). It is alternatively possible for the grooves 22 to principally provide aeration to the surface with which it is in contact, instead of providing a drainage function. Accordingly, the grooves 22 may have upper and lower faces that are generally perpendicular to the plane of the wall component contacted by the first wall component contacting face 14.

It will be appreciated by a person skilled in the art the inner and outer wall components with which the moisture control strip 10 can be used are not limited to those shown in the Figures.

It will be appreciated by one skilled in the art that numerous variations and modifications may be made to the embodiments described above without departing from the scope of the present invention, and all such variations and modifications are intended to be encompassed within the scope of the present invention as defined by the appended claims.

The invention claimed is:

1. In a building having a layered wall comprising an inner wall component, an outer wall component, and at least one moisture control strip disposed between the inner wall component and the outer wall component, the at least one moisture control strip comprising an elongate member having first and second wall component contacting faces, wherein the second wall component contacting face is opposed to the first wall component contacting face, and wherein the member has a width across the first and second wall component contacting faces, wherein the first wall component interface side has a plurality of projections defined thereon, wherein in use the projections are spaced vertically from each other, wherein each projection is separated from adjacent vertically spaced projections by a groove that in use extends downwardly, each groove having two open ends such that the groove is configured to permit drainage of liquids collected therein.

2. The moisture control strip of claim 1, wherein the moisture control strip has a plurality of apertures extending from the second wall component contacting face to the grooves.

3. The moisture control strip of claim 1, wherein each projection on the moisture control strip extends across the entire width of the elongate member.

4. The moisture control strip of claim 1, wherein each groove has an upper face, a lower face and an inner face, and wherein the upper and lower faces are angled downwards in a direction into the moisture control strip.

5. The moisture control strip of claim 1, wherein the projections each have a wall component contacting surface defined thereon and a second groove defined in each wall component contacting surface, wherein the second groove is generally parallel to the longitudinal direction of the moisture control strip.

6. The moisture control strip of claim 2, wherein the second wall component contacting face has recesses that in use extend horizontally and are in fluid flow communication with the apertures.

7. The moisture control strip of claim 6, wherein the apertures are provided in the recesses.

8. A wall comprising an inner wall component, an outer wall component, and a plurality of moisture control strips disposed between the inner wall component and the outer wall component, the moisture control strips each including an elongate member having a first wall component contacting face with a plurality of vertically spaced projections defined thereon and a second wall component contacting face and wherein the projections engage one of the inner wall component and the outer wall component, and wherein the second wall component contacting face engages the other of the inner wall component and the outer wall component, wherein each projection is separated from adjacent vertically spaced projections by a groove that in use extends downwardly, each groove having two open ends such that the groove is configured to permit drainage of liquids collected therein, wherein the moisture control strips are horizontally spaced from each other within the wall.

9. The wall of claim 8, wherein the moisture control strip has a plurality of apertures extending from the second wall component contacting face to the grooves.

10. The wall of claim 8, wherein each projection on the moisture control strip extends across the entire width of the elongate member.

11. The wall of claim 8, wherein each groove has an upper face, a lower face and an inner face, and wherein the upper and lower faces are angled downwards in a direction into the moisture control strip.

12. The wall of claim 8, wherein the projections each have a wall component contacting surface defined thereon, and a second groove defined in each wall component contacting surface, wherein the second groove is generally parallel to the longitudinal direction of the moisture control strip.

13. The wall of claim 8, wherein the second wall component contacting face has recesses that in use extend horizontally and are in fluid flow communication with the apertures.

14. The wall of claim 13, wherein the apertures are provided in the recesses.

* * * * *